US008284001B2

(12) United States Patent
Bourtoutian

(10) Patent No.: US 8,284,001 B2
(45) Date of Patent: Oct. 9, 2012

(54) DIFFERENTIAL FILTERING DEVICE WITH COPLANAR COUPLED RESONATORS AND FILTERING ANTENNA FURNISHED WITH SUCH A DEVICE

(75) Inventor: Raffi Bourtoutian, Rueil-Malmaison (FR)

(73) Assignee: Commissariat à l'Energie Atomique, Paris (FR)

( * ) Notice: Subject to any disclaimer, the term of this patent is extended or adjusted under 35 U.S.C. 154(b) by 439 days.

(21) Appl. No.: 12/610,742

(22) Filed: Nov. 2, 2009

(65) Prior Publication Data

US 2010/0117765 A1 May 13, 2010

(30) Foreign Application Priority Data

Nov. 7, 2008 (FR) ..... 08 06219

(51) Int. Cl.
*H01P 1/20* (2006.01)

(52) U.S. Cl. ..... 333/204; 333/161; 343/895

(58) Field of Classification Search ..... 343/741, 343/742, 816, 895; 333/161, 204, 205
See application file for complete search history.

(56) References Cited

U.S. PATENT DOCUMENTS

| | | | | |
|---|---|---|---|---|
| 6,326,866 | B1 * | 12/2001 | Sasaki et al. | 333/203 |
| 6,356,168 | B1 * | 3/2002 | Barnett et al. | 333/202 |
| 6,356,244 | B1 * | 3/2002 | Mizuno et al. | 343/895 |
| 7,408,512 | B1 * | 8/2008 | Rodenbeck et al. | 343/700 MS |
| 7,982,559 | B2 * | 7/2011 | Mori et al. | 333/204 |
| 2008/0012780 | A1 * | 1/2008 | Harada et al. | 343/859 |

FOREIGN PATENT DOCUMENTS

| | | |
|---|---|---|
| EP | 1 328 039 A2 | 7/2003 |
| EP | 1 562 256 A1 | 8/2005 |
| GB | 2 260 651 A | 4/1993 |
| JP | 2005-333392 | 12/2005 |
| JP | 2007-201764 | 8/2007 |
| WO | WO 98/00880 | 1/1998 |

* cited by examiner

*Primary Examiner* — Tho G Phan

(74) *Attorney, Agent, or Firm* — Oblon, Spivak, McClelland, Maier & Neustadt, L.L.P.

(57) ABSTRACT

A differential filtering device with coupled resonators, including: a pair of coupled resonators disposed on one and the same face of a dielectric substrate, each resonator including two conducting strips positioned in a symmetric manner with respect to a plane perpendicular to the face on which the resonator is disposed, these two conducting strips being joined respectively to two conductors of a bi-strip port for connection to a line for transmitting a differential signal, wherein each conducting strip of each resonator is folded back on itself so as to form a capacitive coupling between its two ends, and wherein the two resonators of the pair are coupled by the disposition opposite one another of their respective conducting strips disposed on the same side with respect to the symmetry plane, over respective portions of length of these folded-back conducting strips.

9 Claims, 5 Drawing Sheets

DIFFERENTIAL FILTERING DEVICE WITH COPLANAR COUPLED RESONATORS AND FILTERING ANTENNA FURNISHED WITH SUCH A DEVICE

The present invention relates to a differential filtering device with coupled resonators. It also relates to a filtering antenna comprising at least one filtering device of this type.

BACKGROUND OF THE INVENTION

Radiofrequency transmission/reception systems fed with differential electrical signals are very attractive for current and future wireless communications systems, in particular for the concepts of autonomous communicating objects. A differential feed is a feed by two signals of equal amplitude in phase opposition. It helps to reduce, or indeed to eliminate, undesirable so-called "common mode" noise in transmission and reception systems.

DESCRIPTION OF THE PRIOR ART

In the realm of mobile telephony for example, when a non-differential system is used, a significant degradation of the radiation performance is indeed observed when the operator holds a handset furnished with such a system. This degradation is caused by the variation, due to the operator's hand, of the distribution of the current over the chassis of the handset used as ground plane. The use of a differential feed renders the system symmetric and thus reduces the concentration of current on the casing of the handset: it therefore renders the handset less sensitive to the common mode noise introduced by the operator's hand.

In the realm of antennas, a non-differential feed gives rise to the radiation of an undesirable cross-component due to the common mode flowing around the non-symmetric feed cables. The use of a differential feed eliminates the cross-radiation of the measurement cables and thus makes it possible to obtain reproducible measurements independent of the measurement context as well as perfectly symmetric radiation patterns.

In the realm of active hardware components, the power amplifiers of "push-pull" type whose structure is differential exhibit several advantages, such as the splitting of the power at output and the elimination of the higher-order harmonics. On reception, low noise differential amplifiers exhibit much promise in terms of noise factor reduction. Hence, the use of a differential structure prevents the undesirable triggering of the oscillators by the common mode noise.

Nevertheless, there are few filters embodied using differential technology. Generally the designers of differential systems use non-differential filters and ensure the switch to differential mode through symmetrizer circuits such as baluns (from the term "BALanced to UNbalanced") which furthermore ensure impedance matching between the two devices to be connected.

The use of baluns involves several drawbacks: increase in bulk and cost and addition of further losses thus reducing the overall performance of the system. Another problem resides in the difficulty of making baluns with wide passband, that is to say capable of ensuring perfect transformation of a non-differential signal into a differential signal over the whole of the passband. They may give rise to the creation of common mode signals and may degrade the overall operation of the system. This results in a pressing requirement to make filters directly using differential technology so as to circumvent all the drawbacks engendered by the use of baluns.

The European patent published under the number EP 0 542 917 B1 presents a differential filter with coupled rings using microstrip technology. This filter comprises two coupled microstrips able to transmit a differential signal.

The major drawback of this type of differential filter using microstrip technology made on a dielectric substrate is the necessity to provide a ground plane on that face of the substrate opposite from that on which the rings are disposed. This filter then cannot be connected directly to a differential dipole antenna because the coupling between the ground plane of the filter and the antenna could degrade the antenna's impedance matching. Moreover, its bi-planar structure makes it necessary to hollow out vias in the substrate for mounting discrete components in series or in parallel.

Moreover, this filter with coupled rings made using microstrip technology exhibits a narrow passband and is therefore not suited to high-speed telecommunications demanding very wide passbands.

The invention therefore relates more precisely to a differential filtering device comprising a pair of coupled resonators disposed on one and the same face of a dielectric substrate, each resonator comprising two conducting strips positioned in a symmetric manner with respect to a plane perpendicular to the face on which the resonator is disposed, these two conducting strips being joined respectively to two conductors of a bi-strip port for connection to a line for transmitting a differential signal.

One technology that can be used to make this type of filter is differential CPS ("CoPlanar Stripline") technology such as is described in the document "Broadband and compact coupled coplanar stripline filters with impedance steps", by Ning Yang et al, IEEE Transactions on Microwave Theory and Techniques, vol. 55, No. 12, December 2007.

In this document, the realization of a filter using differential CPS technology is presented in particular with reference to FIG. 12. CPS technology facilitates the direct connection of this filter with differential radiating devices such as dipole antennas and renders this connection less disturbing to the antennas. This filter comprises two coplanar resonators, each comprising a bi-strip line portion consisting of two parallel rectilinear conducting strips symmetric with respect to a plane perpendicular to the plane of the resonators. This symmetry plane represents a virtual ground plane for the filter on account of its differential character.

Each conducting strip exhibits a length which corresponds to a quarter of the apparent wavelength in the substrate of the filter at the upper operating frequency of the filter. The two conducting strips of one and the same resonator are joined, at one of their two ends, respectively to two conductors of a bi-strip port for connection to a line for transmitting a differential signal. They therefore each retain a free end. The capacitive coupling of the two resonators is then achieved through the disposition opposite one another of the free ends of their respective conducting strips. The bandpass filtering is achieved, on the one hand, through the impedance jumps between each pair of conducting strips and the port to which it is joined and, on the other hand, through the capacitive coupling of the two resonators.

Such a topology makes it possible to reach high passbands with large out-of-band rejection for filters of order 2, 3 or 4. Disposing the two pairs of rectilinear and parallel conducting strips opposite one another involves a dimension of the filter of around half the apparent wavelength at the upper operating frequency, this being relatively compact. This compactness can even be optimized by choosing a substrate whose dielectric properties make it possible to reduce the apparent wavelength. However, certain applications, in particular to autonomous communicating objects of small size, require filters that are yet more compact.

Unfortunately, most known devices using CPS technology are active circuits such as mixers or oscillators, as well as differential amplifiers of push-pull type, or else feed lines of differential antennas or of active circuits. In general, today's differential planar filters are made using microstrip technology. Given that a great deal of know-how exists with regard to making filters using microstrip technology, it is easy to modify them to operate in differential mode. But despite the a priori resemblance of the two technologies, CPS and microstrip, the manner of operation that they involve is totally different. Two structures having the same topology in the upper face of the substrate may show different characteristics because of the distribution of the differing electric and magnetic fields on the two types of lines. Indeed, the presence of the ground plane on the lower face of the microstrip technology substrate completely modifies the manner of operation of a differential microstrip structure with respect to a CPS structure. It is therefore not possible to profit from the know-how in microstrip technology to make CPS filters, these two technologies belonging to very distinct technical realms for making differential filters.

It may thus be desired to provide a differential filtering device exhibiting better compactness while preserving the same performance in terms of passband and rejection as the few known filters made using differential CPS technology.

SUMMARY OF THE INVENTION

The subject of the invention is therefore a differential filtering device with coupled resonators, comprising a pair of coupled resonators disposed on one and the same face of a dielectric substrate, each resonator comprising two conducting strips positioned in a symmetric manner with respect to a plane perpendicular to the face on which the resonator is disposed, these two conducting strips being joined respectively to two conductors of a bi-strip port for connection to a line for transmitting a differential signal, wherein each conducting strip of each resonator is folded back on itself so as to form a capacitive coupling between its two ends.

Thus, the folding back of each conducting strip on itself makes it possible to envisage a smaller filter size, in particular a filter length of less than half the apparent wavelength, for geometric reasons. Furthermore, the fact that this folding back is designed so as to form a capacitive coupling between the two ends of each conducting strip creates at least one additional frequency transmission zero ensuring high performance in terms of passband width and out-of-band rejection of the filtering device. Finally, the capacitive coupling by folding back also generating a magnetic coupling, the size of each conducting strip can be further reduced while ensuring one and the same filtering function of the assembly.

Advantageously, the two resonators of the pair are coupled by the disposition opposite one another of their respective conducting strips disposed on the same side with respect to said symmetry plane, over respective portions of length of these folded-back conducting strips.

The capacitive coupling of the two resonators is thus improved, by not being limited to the coupling of the ends of the conducting strips.

Optionally, each conducting strip of each resonator is of annular general form, its ends being folded back inside the annular general form over a portion of predetermined length of said ends, the fold-back of the ends being situated on a portion of the conducting strip disposed opposite the other conducting strip of the resonator.

The portion of length over which the fold-back is made can be chosen so as to set a certain desired passband of the filtering device.

Optionally also, each conducting strip of each resonator is of rectangular general form.

Optionally also, each conducting strip of each resonator is of square general form.

In this geometric configuration, the compactness is optimal.

Optionally also, at least one part of the portions of conducting strip forming the sides of the rectangular or square general form of each conducting strip comprises additional fold-backs.

Optionally also, the additional fold-backs are directed toward the interior of the rectangular or square general form.

Optionally also, the two conducting strips of one of the two resonators are a first distance apart and the two conducting strips of the other of the two resonators are a second distance apart, this second distance being different from the first distance so that the filtering device fulfills an additional function of impedance matching by exhibiting a different output impedance from its input impedance.

In this case, the filtering device can be used to directly join two circuits of different impedances, such as an antenna and an active circuit.

The subject of the invention is also a differential filtering dipole antenna comprising at least one filtering device such as previously defined.

Optionally, a differential filtering dipole antenna according to the invention can comprise a radiating structure devised so as to integrate in its exterior dimensions said filtering device.

BRIEF DESCRIPTION OF THE DRAWINGS

The invention will be better understood with the aid of the description which follows, given solely by way of example while referring to the appended drawings in which.

DESCRIPTION OF THE PREFERRED EMBODIMENTS

Figure 1:
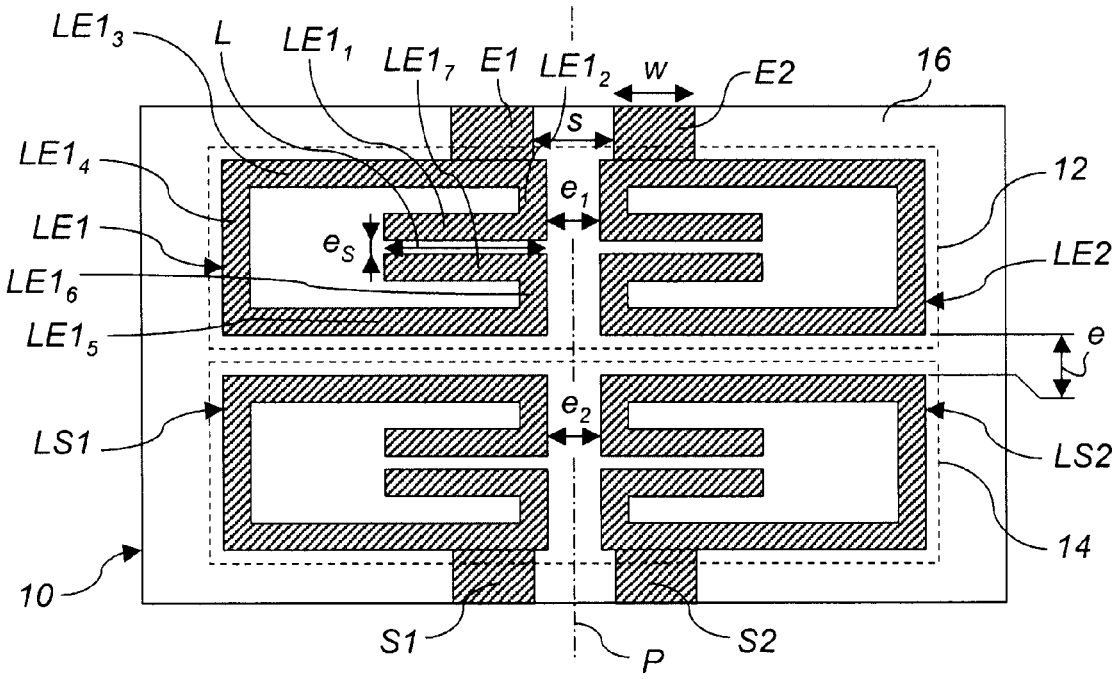
FIG. 1 schematically represents the general structure of a filtering device according to a first embodiment of the invention.

The coupled-resonator differential filtering device 10 represented in FIG. 1 comprises at least one pair of resonators 12 and 14, coupled together by capacitive coupling and disposed on one and the same plane face 16 of a dielectric substrate.

The first resonator 12, consisting of a bi-strip line portion, is linked to two conductors E1 and E2 of a bi-strip port for connection to a line for transmitting a differential signal. These two conductors E1 and E2 of the bi-strip port are symmetric with respect to a plane P perpendicular to the plane face 16 and forming a virtual electrical ground plane. They are of a width w and a distance s apart, these two parameters s and w defining the impedance of the bi-strip port.

Similarly, the second resonator 14, likewise consisting of a bi-strip line portion, is linked to two conductors S1 and S2 of a bi-strip port for connection to a line for transmitting a differential signal. These two conductors S1 and S2 of the bi-strip port are also symmetric with respect to the virtual electrical ground plane P.

The two resonators 12 and 14 are themselves symmetric with respect to an axis normal to the plane P situated on the plane face 16. Consequently, the filtering device 10 is symmetric between its differential input and its differential output so that the latter can be inverted completely. Thus, in the subsequent description of the embodiment represented in FIG. 1, the two conductors E1 and E2 will be chosen by convention as being the input bi-strip port of the filtering device 10, for the reception of an unfiltered differential signal. The two conductors S1 and S2 will be chosen by convention as being the output bi-strip port of the filtering device 10, for the provision of the filtered differential signal.

More precisely, the first resonator 12 comprises two conducting strips identified by their references LE1 and LE2. These two conducting strips LE1 and LE2 are positioned in a symmetric manner with respect to the virtual electrical ground plane P. They are respectively linked to the two conductors E1 and E2 of the input port. The second resonator 14 comprises two conducting strips identified by their references LS1 and LS2. These two conducting strips LS1 and LS2 are also positioned in a symmetric manner with respect to the virtual electrical ground plane P. They are respectively linked to the two conductors S1 and S2 of the output port.

The capacitive coupling of the two resonators 12 and 14 is ensured by the opposite but contactless disposition of their respective pairs of conducting strips. Thus, the conducting strips LE1 and LS1, situated on one and the same side with respect to the virtual electrical ground plane P, are disposed opposite one another a distance e apart. Likewise, the conducting strips LE2 and LS2, situated on the other side with respect to the virtual electrical ground plane P, are disposed opposite one another the same distance e apart.

This distance e between the two resonators 12 and 14 influences mainly the passband of the filtering device 10 and has a secondary effect on its characteristic impedance. The more e decreases, that is to say the higher the capacitive coupling between the two resonators, the wider the passband. The effect of this is also to increase the impedance. More precisely, the passband is widened by the appearance of two distinct reflection zeros inside this passband, corresponding to two distinct resonant frequencies, when e is small enough to produce the capacitive coupling between the two resonators. The shorter the distance e, the further apart the two reflection zeros created move, thus widening the passband. However, if they are too far apart, they can cause the widened passband to split into two distinct passbands through the reappearance of a sizeable reflection between the two zeros, this running counter to the effect sought. Consequently, the distance e must be small enough to increase the passband but also sizeable enough not to generate undesired reflection inside the passband.

In a conventional manner, for good operation of the resonators of a filtering device with coupled resonators, each conducting strip must be of length $\lambda/4$, where $\lambda$ is the apparent wavelength, for a substrate considered, corresponding to the upper operating frequency of the filtering device. Thus, if the conducting strips were disposed linearly straight in line with the input and output ports of the filtering device 10, the assembly would reach a length of around $\lambda/2$: in practice, for a frequency of 3 GHz, a length close to 3 cm would be obtained for example.

But in fact, the conducting strips LE1, LE2, LS1 and LS2 are advantageously folded back on themselves so as to form additional capacitive and magnetic couplings locally between their two ends. The size of the filtering device 10 is thus reduced for at least two reasons: geometrically the fold-backs cause a reduction in the size of the assembly, but furthermore, by virtue of the capacitive and magnetic couplings, the size of each conducting strip can further be reduced while ensuring good operation of the resonators. This capacitive and magnetic coupling moreover generates a feedback between the input and the output of each conducting strip, so as to create one or more additional transmission zeros at frequencies greater than the upper limit of the passband of the filtering device 10. The high-band rejection is thus improved.

In the embodiment illustrated in FIG. 1, the four conducting strips are of annular general form, their ends being folded back inside this annular general form over a predetermined portion of their length.

For good operation of the filtering device 10, the fold-back of the ends of each conducting strip is situated on a portion of this conducting strip disposed opposite the other conducting strip of the same resonator. Thus, the fold-backs of ends of the conducting strips LE1 and LE2 are disposed opposite one another on either side of the symmetry plane P and in proximity to the latter.

More precisely, the conducting strip LE1 is of rectangular general form and consists of rectilinear conducting segments. A first segment $LE1_1$ comprising a first free end of the conducting strip LE1 extends toward the interior of the rectangle formed by the conducting strip over a length L in a direction orthogonal to the virtual ground plane P. A second segment $LE1_2$, joined to this first segment at right angles, constitutes a part of the side of the rectangle parallel to the virtual ground plane P and close to the latter. A third segment $LE1_3$, joined to this second segment at right angles, constitutes the side of the rectangle orthogonal to the virtual ground plane P and linked to the conductor E1 of the input port. A fourth segment $LE1_4$, joined to this third segment at right angles, constitutes the side of the rectangle parallel to the virtual ground plane P and close to an outer edge of the substrate. A fifth segment $LE1_5$, joined to this fourth segment at right angles, constitutes the side of the rectangle orthogonal to the virtual ground plane P and opposite from the side $LE1_3$. A sixth segment $LE1_6$, joined to this fifth segment at right angles, constitutes like the second segment $LE1_2$ a part of the side of the rectangle parallel to the virtual ground plane P and close to the latter. Finally, a seventh segment $LE1_7$ comprising the second free end of the conducting strip LE1, joined to the sixth segment at right angles, extends toward the interior of the rectangle over the length L in a direction orthogonal to the virtual ground plane P, that is to say parallel to the segment $LE1_1$ and opposite the latter over the whole of the length L of fold-back.

The segments $LE1_1$ and $LE1_7$ are a constant distance $e_s$ apart over the whole of their length thereby ensuring their capacitive coupling.

The conducting strip LE1 can also be viewed as consisting of a folded main conducting strip joined at one of its ends to the conductor E1, this main conducting strip comprising the segments $LE1_1$, $LE1_2$ and that part of the segment $LE1_3$ situated between the segment $LE1_2$ and the conductor E1, and of a "stub"-type branch-off folded back on the main conducting strip, this "stub"-type branch-off comprising the other part of the segment $LE1_3$, and the segments $LE1_4$ to $LE1_7$. The "stub"-type branch-off is then considered to be placed at the junction between the main conducting strip and the conductor E1. It ought theoretically to exhibit a total length of λ/4, but the capacitive and magnetic couplings caused by the folding back of the conducting strip LE1 on itself make it possible to reduce this length, in particular by 10 to 20% on the "stub" branch-off.

It is moreover interesting to note that a sufficiently reduced size of the segment $LE1_4$ makes it possible for the segments $LE1_3$ and $LE1_5$, and also the segments $LE1_3$ and $LE1_1$, or the segments $LE1_5$ and $LE1_7$, to be brought closer together so as to multiply the number of capacitive and magnetic couplings caused by the folding back of the conducting strip LE1 on itself. These multiple couplings improve the operation of the filtering device 10.

The length L of coupling between the two folded-back ends, i.e. the two segments $LE1_1$ and $LE1_7$, mainly influences the passband of the filtering device 10, but also has a secondary effect on the high-band rejection. The more it increases, the more the passband is reduced but the more the high-band rejection is improved.

The distance $e_s$ between the two folded-back ends mainly influences the high-band rejection of the filtering device 10: the more it is reduced, the more the high-band rejection is improved. It will be noted however that this distance may not be less than a limit imposed by the precision of the etching of the conducting strip LE1 on the substrate.

The conducting strip LE2 consists, like the conducting strip LE1, of seven conducting segments LE2, to $LE2_7$ disposed on the plane face 16 of the substrate in a symmetric manner to the seven segments $LE1_1$ to $LE1_7$ with respect to the virtual ground plane P. The two conducting strips LE1 and LE2 are a constant distance $e_1$ apart, corresponding to the distance which separates the segments $LE1_2$ and $LE1_6$, on the one hand, from the segments $LE2_2$ and $LE2_6$, on the other hand.

This distance $e_1$ mainly influences the impedance of the first resonator 12, that is to say the input impedance of the filtering device 10, but also has a secondary effect on the passband of the filtering device 10. The more it increases, the more the impedance increases and in a less marked manner, the more the passband is reduced.

The two resonators 12 and 14 being symmetric with respect to an axis normal to the virtual ground plane P situated on the plane face 16, the conducting strips LS1 and LS2 are each constituted, as the conducting strips LE1 and LE2, of seven conducting segments $LS1_1$ to $LS1_7$ and $LS2_1$ to $LS2_7$ respectively, printed on the plane face 16 of the substrate in a symmetric manner to the segments of the conducting strips LE1 and LE2 with respect to this axis. Also by symmetry, the two conducting strips LS1 and LS2 are a constant distance $e_2$ apart, equal to $e_1$, corresponding to the distance which separates the segments $LS1_2$ and $LS1_6$, on the one hand, from the segments $LS2_2$ and $LS2_6$, on the other hand.

This distance $e_2$ also influences mainly the impedance of the second resonator 14, that is to say the output impedance of the filtering device 10, but also has a secondary effect on the passband of the filtering device 10. The more it increases, the more the impedance increases and in a less marked manner, the more the passband is reduced.

The distance e separating the two resonators 12 and 14 corresponds to the distance which separates the segments $LE1_5$ and $LE2_5$, on the one hand, from the segments $LS1_5$ and $LS2_5$, on the other hand. The capacitive coupling between the two resonators 12 and 14 is therefore established over the whole of the length of the segments $LE1_5$ and $LE2_5$, on the one hand, and of the segments $LS1_5$ and $LS2_5$, on the other hand.

A topology such as that illustrated in FIG. 1, where the length of the rectangle formed by any one of the conducting strips is about twice as large as its width and where the fold-back of length L is made over half the length of the rectangle inside the latter, yields dimensions of around λ/30 by λ/60 for the rectangle formed by each conducting strip, i.e. dimensions of around λ/15 by λ/30 for the filtering device 10. These dimensions make it possible to achieve markedly better compactness than those of the existing devices.

Figure 2:
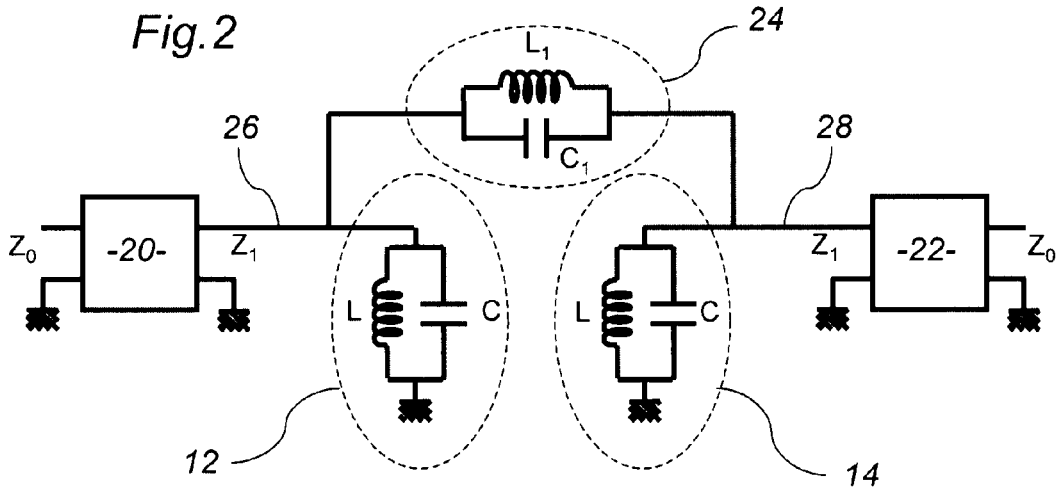
FIG. 2 represents an equivalent electrical diagram of the filtering device of FIG. 1.

FIG. 2 schematically presents an equivalent electrical circuit of the filtering device 10 previously described.

In this circuit, a first inverter 20 represents an impedance jump, from $Z_0$ to $Z_1$, at the input of the filtering device 10. The impedance $Z_0$ is determined by the parameters s and w of the conductors E1 and E2 of the input port, while the impedance $Z_1$ is determined in particular by the distance $e_1$ between the conducting strips LE1 and LE2.

A second inverter 22 represents the corresponding impedance jump, from $Z_1$ to $Z_0$, at the output of the filtering device 10.

The first and second coupled resonators 12 and 14 are each represented by an LC circuit with capacitance C and inductance L in parallel. These two LC circuits are linked, on the one hand, respectively to the first and second inverters 20 and 22 and, on the other hand, to the ground.

Finally, the folding back of the conducting strips LE1, LE2, LS1 and LS2 creates additional couplings, inside each resonator but also between the resonators, that can be represented by an LC feedback circuit 24, with capacitance C1 and inductance L1 in parallel, linked, on the one hand, to the junction 26 between the first resonator 12 and the first inverter 20 and, on the other hand, to the junction 28 between the second resonator 14 and the second inverter 22. This LC feedback circuit 24 improves the high-band rejection of the filtering device 10 by adding one or more transmission zeros in the high frequencies.

Figure 3:
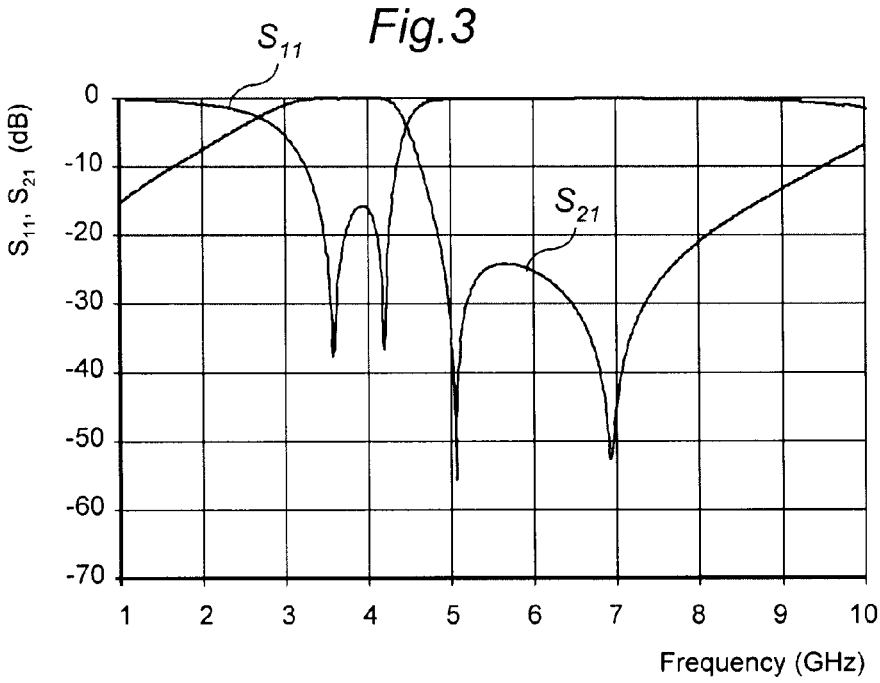
FIG. 3 illustrates the characteristic of a frequency response in terms of transmission and reflection of the filtering device of FIG. 1, FIG. 4 schematically represents the general structure of a filtering device according to a second embodiment of the invention, FIG. 5 schematically represents the general structure of a filtering and impedance matching assembly with two filters such as that of FIG. 4, according to an embodiment of the invention, FIG. 6 schematically represents the general structure of a filtering device according to a third embodiment of the invention, FIGS. 7, 8 and 9 schematically represent three embodiments of filtering antennas according to the invention.

The graph illustrated in FIG. 3 represents the characteristic of a frequency response in terms of transmission and reflection of the filtering device previously described.

The reflection coefficient $S_{11}$ of this frequency response shows a −10 dB passband (generally accepted definition of the passband in reflection) lying between about 3.2 and 4.4 GHz. As indicated previously, the passband is widened by the presence of two distinct reflection zeros inside this passband, these two zeros being due to the presence of the two coupled resonators a distance e apart in the filtering device 10. However, it is clearly seen in FIG. 3 that if they are too far apart, the portion of curve $S_{11}$ situated between these two reflection zeros may rise back above −10 dB, thereby causing the widened passband to split into two distinct passbands. Consequently, the distance e must not be too small so as not to cause reflection of greater than −10 dB in the widened passband.

The transmission coefficient $S_{21}$ of the frequency response shows a −3 dB passband (generally accepted definition of the passband in transmission) lying between about 2.7 and 4.5 GHz, as well as two transmission zeros at about 5.1 and 6.9 GHz.

One of these two out-of-band transmission zeros is due to the coupling between the two resonators of the filtering device 10 over the whole of the length of their portions $LE1_5$, $LE2_5$ on the one hand and $LS1_5$, $LS2_5$ on the other hand. The other of these two transmission zeros is due to the additional intra-resonator couplings created by the folding back of the conducting strips on themselves. These two transmission zeros give rise to a large high-band rejection of the filter and an asymmetry of the frequency response on account of the medium low-band rejection. But this asymmetry can turn out to be advantageous, in particular for an application relating to the direct integration of the filtering device 10 into a differential antenna. Indeed, such antennas generally exhibit large resonances at low frequency and are consequently equivalent to high-pass filters, thereby compensating for the asymmetry of the filtering device 10, improving its low-band rejection.

Figure 4:
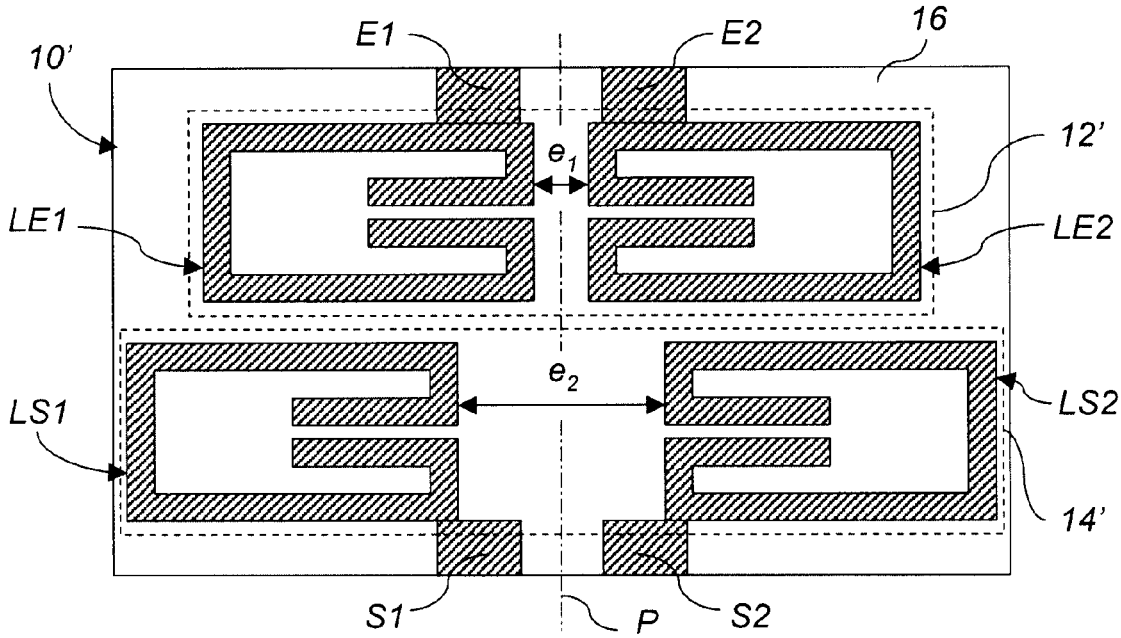

A second embodiment of a differential filtering device according to the invention is represented schematically in FIG. 4. This device 10' comprises a pair of resonators 12' and 14', coupled together by capacitive coupling and disposed on one and the same plane face 16 of a dielectric substrate. These two resonators are similar to those, 12 and 14, of the device of FIG. 1.

On the other hand, in this second embodiment, the two resonators 12' and 14' are not symmetric with respect to an axis normal to the plane P situated on the plane face 16. Indeed, the distance $e_1$ separating the two conducting strips LE1 and LE2 of the first resonator 12' is different from the distance $e_2$ separating the two conducting strips LS1 and LS2 of the second resonator 12'. In the example illustrated, the distance $e_2$ is greater than the distance $e_1$.

However, the capacitive coupling between the two resonators 12' and 14' is not broken for all that. Indeed, on account of the folding back of the conducting strips on themselves, the latter remain opposite one another over at least a portion of their length, more precisely over at least a portion of the lengths $LE1_5$ and $LS1_5$, on the one hand, and of the lengths $LE2_5$ and $LS2_5$, on the other hand. In comparison with the existing one, it would not for example be possible to design such a difference between the distances $e_1$ and $e_2$ in the filtering device described with reference to FIG. 12 of the aforementioned document "Broadband and compact coupled coplanar stripline filters with impedance steps", because in this document, it is the free ends of the conducting strips which are disposed opposite one another so that a shift, even slight, between them would break the capacitive coupling between the two resonators.

Since these distances $e_1$ and $e_2$ make it possible to adjust respectively the input and output impedances of the filtering device 10', it is thus possible to design a bandpass filtering device which furthermore fulfills a function of impedance matching between the circuits to which it is intended to be connected. In the example illustrated in FIG. 4, the distance $e_1$ thus causes an input impedance $Z_1$ that is less than the output impedance $Z_2$ caused by the distance $e_2$.

This second embodiment allows the direct integration of a filtering device according to the invention with differential antennas and differential active circuits of different impedances. It will be noted however that direct integration such as this with a single filtering device operates all the better the smaller the difference between the impedances $Z_1$ and $Z_2$.

Alternatively, an assembly of several filtering devices according to the second embodiment of the invention added in series can be used so as to facilitate the impedance matching between circuits with very different impedances.

Figure 5:
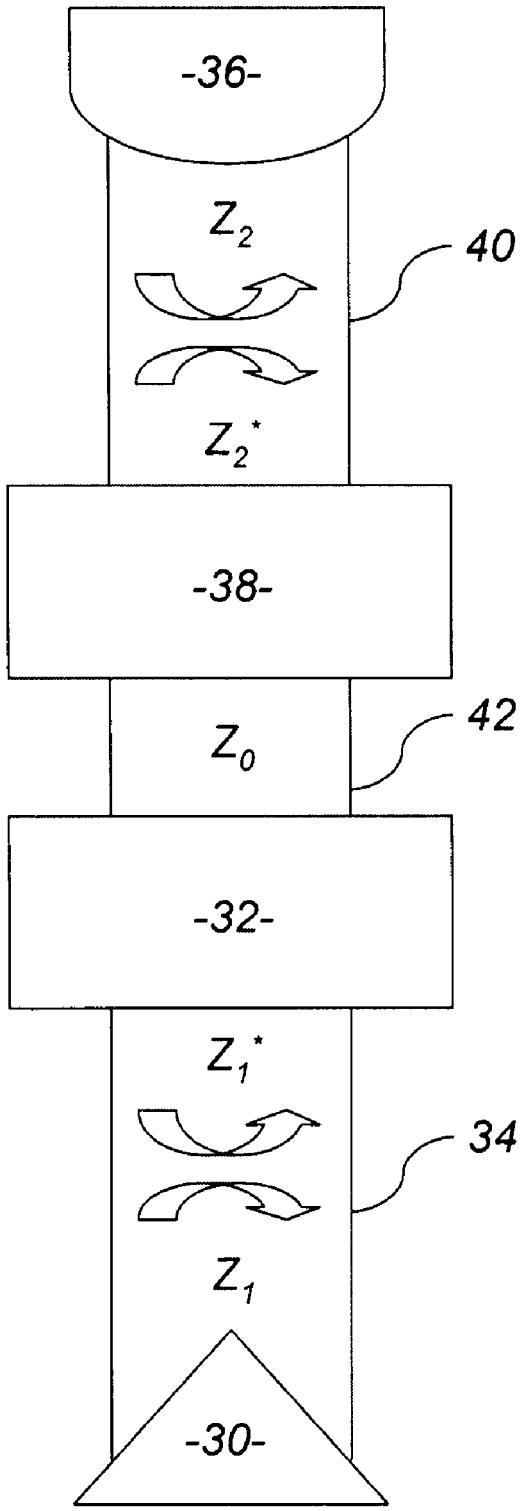

Such an assembly with two filtering devices is for example represented schematically in FIG. 5.

In this assembly, an amplifier 30 is joined to the input of a first filtering device 32, via the input port 34 of this first filtering device. The impedance of the amplifier 30 having a value $Z_1$, the first filtering device 32 is designed, by adjustment of the distance between the folded-back conducting strips of its first resonator, to exhibit an input impedance of conjugate value $Z_1$* thus ensuring maximum transfer of power between the first filtering device 32 and the amplifier 30.

An antenna 36 is joined to the output of a second filtering device 38, via the output port 40 of this second filtering device. The impedance of the antenna 36 having a value $Z_2$, the second filtering device 38 is designed, by adjustment of the distance between the folded-back conducting strips of its second resonator, to exhibit an output impedance of conjugate value $Z_2$* thus ensuring maximum transfer of power between the second filtering device 38 and the antenna 36.

Finally, the two filtering devices 32 and 38 are joined together, either directly, or indirectly via a quarter-wave line 42 fulfilling an inverter function, the output of the first filtering device 32 and the input of the second filtering device 38 being designed, by adjustment of the distance between the folded-back conducting strips of the second resonator of the first filtering device 32 and of the distance between the folded-back conducting strips of the first resonator of the second filtering device 38, to exhibit one and the same impedance $Z_0$. This same impedance $Z_0$ ensures the matching of impedances and can be chosen so as to ensure the best possible rejection.

Thus, the matching of the impedances $Z_1$ and $Z_2$ which may be very different is done by passing through an intermediate impedance $Z_0$ by virtue of the assembly comprising the two asymmetric filtering devices 32 and 38.

The optional presence of a quarter-wave line 42 between the two filtering devices 32 and 38 furthermore makes it possible to globally improve the performance of the higher-order filter thus constructed, in terms of passband.

Figure 6:
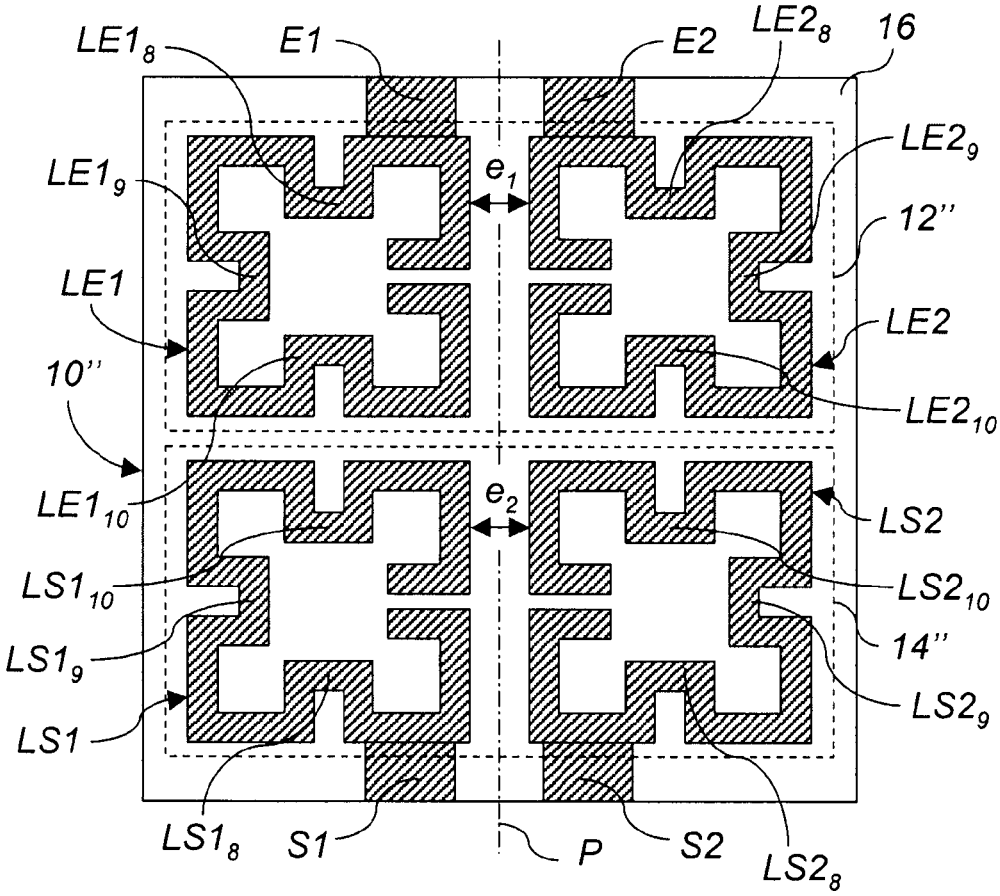

A third embodiment of a differential filtering device according to the invention is represented schematically in FIG. 6. This filtering device 10" comprises a pair of resonators 12" and 14", coupled together by capacitive coupling and disposed on one and the same plane face 16 of a dielectric substrate.

In this third embodiment, the two resonators 12" and 14" are symmetric with respect to an axis normal to the plane P situated on the plane face 16. Consequently, the distance $e_1$ separating the two conducting strips LE1 and LE2 of the first resonator 12" is equal to the distance $e_2$ separating the two conducting strips LS1 and LS2 of the second resonator 14". As a variant, in another embodiment, these two distances could be different, as in the second embodiment, so that the filtering device furthermore fulfills an impedance matching function.

On the other hand, this third embodiment is distinguished from the first and second embodiments by the general form of the folded-back conducting strips.

Indeed, in this embodiment, the four conducting strips are of annular general form, their ends being folded back inside this annular general form over a predetermined portion of their length, but they are more precisely of square general form. Furthermore, each of them comprises additional fold-backs over at least a part of the sides of the square general form.

For example, the conducting strip LE1 comprises three additional fold-backs $LE1_8$, $LE1_9$ and $LE1_{10}$ in the three sides of the square general form not comprising the fold-back of its two ends. To improve the compactness of the assembly, the three additional fold-backs are directed toward the interior of the square general form. They are for example notch-shaped. By symmetry, the conducting strips LE2, LS1 and LS2 comprise the same additional fold-backs, referenced $LE2_8$, $LE2_9$ and $LE2_{10}$ for the conducting strip LE2; $LS1_8$, $LS1_9$ and $LS1_{10}$ for the conducting strip LS1; $LS2_8$, $LS2_9$ and $LS2_{10}$ for the conducting strip LS2.

In this embodiment, the square general form of each conducting strip LE1, LE2, LS1 and LS2 implies a square general form of the filtering device 10". The compactness of the latter is therefore optimal.

Moreover, the additional fold-backs create additional capacitive and magnetic couplings that may further improve the performance of the filtering device 10".

As indicated previously, the length L of the fold-back of the two ends of each conducting strip inside its square general form can be adjusted so as to adjust the passband of the filtering device 10".

In this square topology, dimensions of the filtering device 10" of around $\lambda/20$ per side are for example obtained. It will be noted that a filtering device according to the invention is not limited to the embodiments described above. Other geometric forms are conceivable for a filtering device according to the invention, so long as they provide for a fold-back of each conducting strip of each resonator on itself so as to form a capacitive coupling between its two ends.

Figure 7:
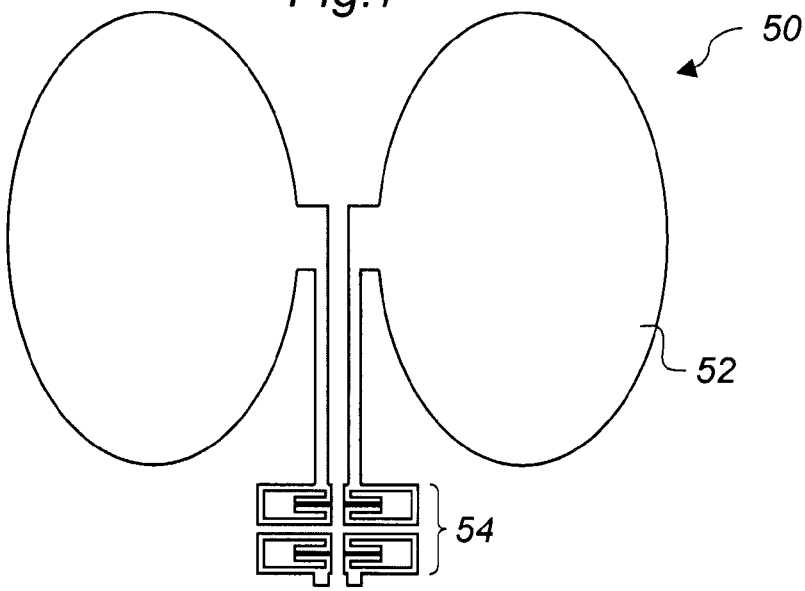
Figure 8:
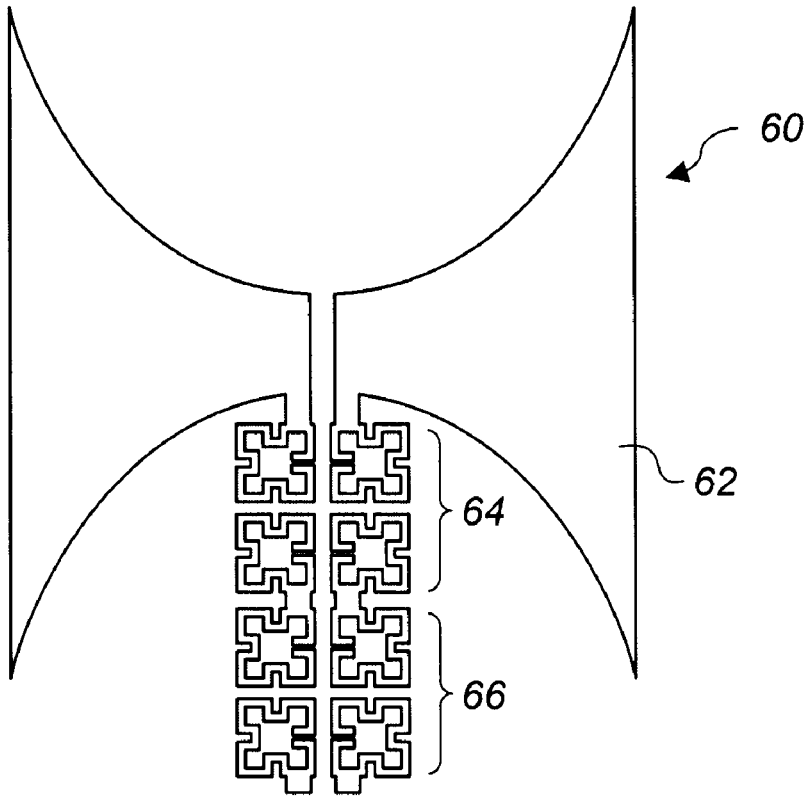
Figure 9:
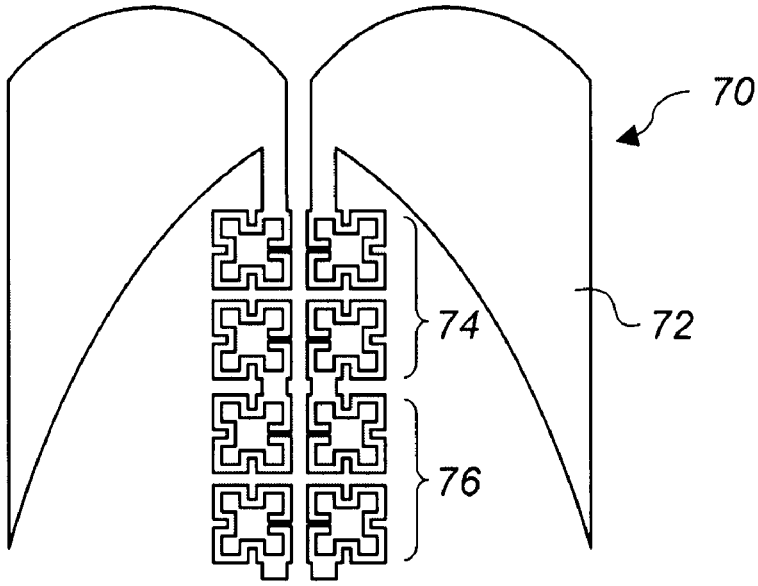

FIGS. 7 to 9 schematically illustrate three examples of differential filtering dipole antennas each advantageously integrating at least one filtering device such as those previously described.

The filtering dipole antenna 50 represented in FIG. 7 comprises on the one hand a radiating electric dipole 52 and on the other hand a filtering device 54 such as that described with reference to FIG. 1. The electric dipole 52 is more precisely a coplanar thick dipole etched on a substrate and whose radiating structure is of elliptical form. This type of dipole has a very wide passband. The relative passband defined by the relation $\Delta f/f_0$, where $\Delta f$ is the width of the passband and $f_0$ the central operating frequency of the antenna, can exceed 100%.

The two arms of the dipole 52 are connected directly to the two conductors of the output port of the filtering device 54. As a variant, the dipole 52 and the filtering device 54 could be connected by way of a quarter-wave line: this would make it possible to obtain a filtering antenna with improved performance. The two conductors of the input port of the filtering device 54 are for their part intended to be fed with differential signal.

The filtering dipole antenna 60 represented in FIG. 8 comprises on the one hand a radiating electric dipole 62 and on the other hand a filtering assembly comprising two filtering devices 64 and 66 such as that described with reference to FIG. 6. The electric dipole 62 is more precisely a coplanar thick dipole etched on a substrate and whose radiating structure is of "butterfly" form. More precisely, the radiating structure of the dipole exhibits a fine part, in a central zone of the antenna comprising the connection to the filtering devices 64 and 66, which widens out toward the exterior of the antenna on both sides of the dipole. This type of radiating dipole has a medium passband. Its relative passband $\Delta f/f_0$ is of the order of 20%.

The two arms of the dipole 62 are connected directly to the two conductors of the output port of the first filtering device 64. As a variant, the dipole 62 and the first filtering device 64 could be connected by way of a quarter-wave line.

The two conductors of the input port of the first filtering device 64 are connected directly to the two conductors of the output port of the second filtering device 66. As a variant also, the first filtering device 64 and the second filtering device 66 could be connected by way of a quarter-wave line to obtain a higher-order filter with improved performance. The two conductors of the input port of the second filtering device 66 are for their part intended to be fed with differential signal.

Finally, the filtering dipole antenna 70 represented in FIG. 9 comprises on the one hand a radiating electric dipole 72 and on the other hand a filtering assembly comprising two filtering devices 74 and 76 identical to the two devices 64 and 66. The electric dipole 72 is more precisely a coplanar thick dipole etched on a substrate and whose radiating structure is of "butterfly" form. It differs however from the electric dipole 62 in particular in that the two wide ends of its radiating structure, oriented toward the exterior of the antenna, are devised so as to integrate in their exterior dimensions (i.e. larger length and larger width) the two filtering devices 74 and 76. This results in an additional gain in the compactness of the filtering antenna 70 with respect to the filtering antenna 60.

Moreover, as in the previous example:

- the two arms of the dipole 72 are connected directly to the two conductors of the output port of the first filtering device 74,
- the two conductors of the input port of the first filtering device 74 are connected directly to the two conductors of the output port of the second filtering device 76, and
- the two conductors of the input port of the second filtering device 76 are for their part intended to be fed with differential signal.

For a constant number of filtering devices, a differential filtering dipole antenna according to the invention is smaller than a conventional corresponding antenna, by virtue of the better compactness of the filtering devices used. Alternatively, for a constant overall size, a differential filtering dipole antenna according to the invention is more efficacious because it can comprise a larger number of filtering devices making it possible to carry out a filtering of yet higher order, which is therefore more efficacious in terms of passband.

It is clearly apparent that a filtering device such as one of those previously described can achieve a much better compactness than that of the known differential filters made using CPS technology, while retaining their advantages.

Having regard to the frequency bands in which it can operate, it is particularly suited to the new radiocommunication protocols which require very wide passbands. Its compactness and its high performance render it furthermore advantageous for miniature communicating objects.

The coplanar structure of this filtering device furthermore facilitates its realization using hybrid technology and its integration using monolithic technology with structures comprising discrete surface-mounted elements. In particular, it is simple to design it integrated with a differential dipole antenna with broadband coplanar radiating structure, as has been illustrated by several examples, by chemical or mechanical etching on substrates of low or high permittivity according to the desired applications and performance.

This filtering device can also find applications in the millimetric frequency band where its small size and its high performance allow it to be integrated using monolithic technology with antennas and active circuits.

Finally, more specifically, the possibility of adjusting the input and output impedances of this filter differently, in accordance with the second embodiment described, makes it possible to envisage the joint design of this type of filtering device with antennas and active circuits exhibiting different impedances.

The invention claimed is:

1. A differential filtering device, comprising:

a pair of coupled resonators disposed on one and the same face of a dielectric substrate, each resonator comprising two conducting strips positioned in a symmetric manner with respect to a plane perpendicular to the face on which the resonator is disposed, these two conducting strips being joined respectively to two conductors of a bi-strip port for connection to a line for transmitting a differential signal, wherein each conducting strip of each resonator is folded back on itself so as to form a capacitive coupling between its two ends, and wherein the two resonators of the pair are coupled by the disposition opposite one another of their respective conducting strips disposed on the same side with respect to said symmetry plane, over respective portions of length of these folded-back conducting strips.

2. The differential filtering device as claimed in claim 1, in which each conducting strip of each resonator is of annular general form, ends of each conducing strip being folded back inside the annular general form over a portion of predetermined length of said ends, the fold-back of the ends being situated on a portion of the conducting strip disposed opposite the other conducting strip of the resonator.

3. The differential filtering device as claimed in claim 2, in which each conducting strip of each resonator is of rectangular general form.

4. The differential filtering device as claimed in claim 3, in which each conducting strip of each resonator is of square general form.

5. The differential filtering device as claimed in claim 3 or 4, in which at least one part of the portions of conducting strip forming the sides of the rectangular or square general form of each conducting strip comprises additional fold-backs.

6. The differential filtering device as claimed in claim 5, in which the additional fold-backs are directed toward the interior of the rectangular or square general form.

7. The differential filtering device as claimed in claim 1, in which the two conducting strips of one of the two resonators are a first distance apart and the two conducting strips of the other of the two resonators are a second distance apart, this second distance being different from the first distance so that the filtering device fulfills an additional function of impedance matching by exhibiting a different output impedance from its input impedance.

8. A differential filtering dipole antenna comprising at least one filtering device as claimed in claim 1.

9. The differential filtering dipole antenna as claimed in claim 8, further comprising a radiating structure devised so as to integrate, within exterior dimensions of said radiating structure, said filtering device.

* * * * *